US006068384A

United States Patent [19]

Tyson et al.

[11] Patent Number: 6,068,384

[45] Date of Patent: May 30, 2000

[54] LIGHTING SYSTEM

[75] Inventors: Glenn M. Tyson, La Crescenta; Charles B. Poppenheimer, La Canada-Flintridge; Michael Leonhardt, Castaic, all of Calif.

[73] Assignee: NSI Enterprises, Inc., Atlanta, Ga.

[21] Appl. No.: 09/056,232

[22] Filed: Apr. 7, 1998

[51] Int. Cl.[7] ..... F21V 29/00

[52] U.S. Cl. ..... 362/153.1; 362/373; 362/294; 362/428; 362/287; 362/375

[58] Field of Search ..... 362/153.1, 373, 362/294, 427, 428, 287, 289, 374, 375

[56] References Cited

U.S. PATENT DOCUMENTS

| | | | |
|---|---|---|---|
| 4,343,033 | 8/1982 | Suzuki | 362/375 X |
| 4,931,914 | 6/1990 | Quiogue | 362/153.1 X |
| 5,050,052 | 9/1991 | Wade | 362/374 X |
| 5,335,151 | 8/1994 | Dahlberg | 362/153.1 |
| 5,481,443 | 1/1996 | Wagner et al. | 362/153.1 |
| 5,486,988 | 1/1996 | Tyson | 362/153.1 X |
| 5,779,349 | 6/1998 | Reinert, Sr. | 362/153.1 |
| 5,908,236 | 6/1999 | Lueken et al. | 362/153.1 X |

*Primary Examiner*—Laura K. Tso
*Attorney, Agent, or Firm*—Lyon & Lyon LLP

[57] ABSTRACT

A lamp assembly for outdoor purpose includes a housing, a lamp module, and a potted power module. A support ring is positioned within the housing so as to connect the housing to the lamp module. An additional tilt ring may be connected therewith to provide an additional degree of movement. The support ring and, if included, the associated tilt ring has the ability to key the lamp module to the housing. This makes it possible to relamp or perform maintenance on the lamp without affecting the aim or distribution of the light. In addition, the lamp assembly preferably includes at least one flue plate disposed between the lamp module and the housing to form at least one flue, the at least one flue advantageously creates and maintains convective cooling within the housing of the lamp assembly during operation.

22 Claims, 14 Drawing Sheets

LIGHTING SYSTEM

BACKGROUND OF THE INVENTION

The field of the invention is lighting systems for outdoor lighting purposes.

Outdoor lighting systems have an infinite number of applications for outdoor illumination. Such lighting systems can be used to illuminate and thus enhance the effects of a variety of objects such as flagpoles, signs, shrubbery, and other architectural points of interest. Outdoor lighting can also provide general flood lighting to areas for security purposes and spot lighting where desired.

The placement and location of conventional lighting systems for outdoor use are severely restricted. Conventional designs can be vulnerable to the destructive effects of corrosive soils, human foot traffic and moisture and water intrusion. Thus, above ground placement is required. However, above ground placement of lighting systems can detract from the aesthetics of the lighted area and can restrict the utility of such systems.

U.S. Reissue Pat. No. 34,709, and U.S. Pat. Nos. 5,198,962, 5,276,583, 5,408,397, 5,486,988, 5,727,873, all incorporated herein by reference, describe a lighting system and construction thereof that overcomes the above-identified limitations. The construction includes improved sealing mechanisms for lighting assemblies, non-corrosive materials and rugged structures providing improved and reliable outdoor lighting features. The lighting system provides versatile designs for maximum utility and lower maintenance over conventional outdoor lighting systems.

There remains, however, a need to further improve the design of outdoor lighting systems in a number of ways. For example, it is desirable to improve the cooling aspects of lamp assembly designs. Improving cooling provides for higher intensity lighting in smaller fixtures. Simply cutting holes in the fixtures often is not enough because of heat stratification within the housing. Preservation of the architectural effect of such outdoor lighting systems is also desired. Lamps are carefully aimed, lenses rotated and reflectors selected to provide advantageous architectural results. Upon relamping, the original adjustments are often lost and no thought is given to reestablishing the architectural effect.

SUMMARY OF THE INVENTION

The present invention is directed to an improved ingrade outdoor lighting system.

In a first separate aspect of the present invention, a lamp assembly has a housing having a seat for positioning a support ring within the housing. A retainer keeps the support ring from rotating. A lamp module is removably mounted on the support ring and located via a key and keyway. The support ring provides for optic adjustment to the lamp assembly which can be recaptured after relamping. The lamp module and support ring may cooperate to prevent assembly of the lamp without alignment.

In a second separate aspect of the invention, a lamp assembly has a housing having a seat for positioning a support ring within the housing. A tilt ring is associated with the support ring. The support ring can be adjusted through rotation and retained and the tilt ring on the support ring can be tilted and retained by an adjustment piece. A lamp module is removably mounted to the tilt ring and located via a key and keyway. Thus, the two degrees of freedom of optical adjustment can be recaptured after relamping. The lamp module and tilt ring may cooperate to prevent assembly of the lamp without alignment.

In a third separate aspect of the invention, a lamp assembly includes a housing having a seat for positioning a support ring within the housing. A retainer keeps the support ring from rotating. A lamp module is removably mounted on the support ring and located via a key and keyway. The lamp module includes a socket enclosure and a lens. An optics key and keyway places the lens in proper alignment with the socket enclosure. The support ring provides for optic adjustment to the lamp assembly which can be recaptured after relamping with the lens also properly positioned. The optics key may interfere with the assembly of the lens with the socket enclosure if not aligned.

In a fourth separate aspect of the invention, a lamp assembly includes a housing having a lamp module within the housing and a lens extending across the opening of the housing with an annular space thereabout. An annular ring extends between the module and the housing and has passages therethrough. Flue plates defining flues extend into the housing from the annular ring from the passages. A convective cooling flow is created and maintained within the housing during operation through the flues and passages.

In a fifth separate aspect of the invention, the foregoing separate aspects are contemplated to be used in combination to improve lamp operation.

Accordingly, it is an object of the present invention to provide an improved lamp assembly. Other and further objects and advantages will appear hereafter.

DETAILED DESCRIPTION OF THE PREFERRED EMBODIMENTS

Figure 1:
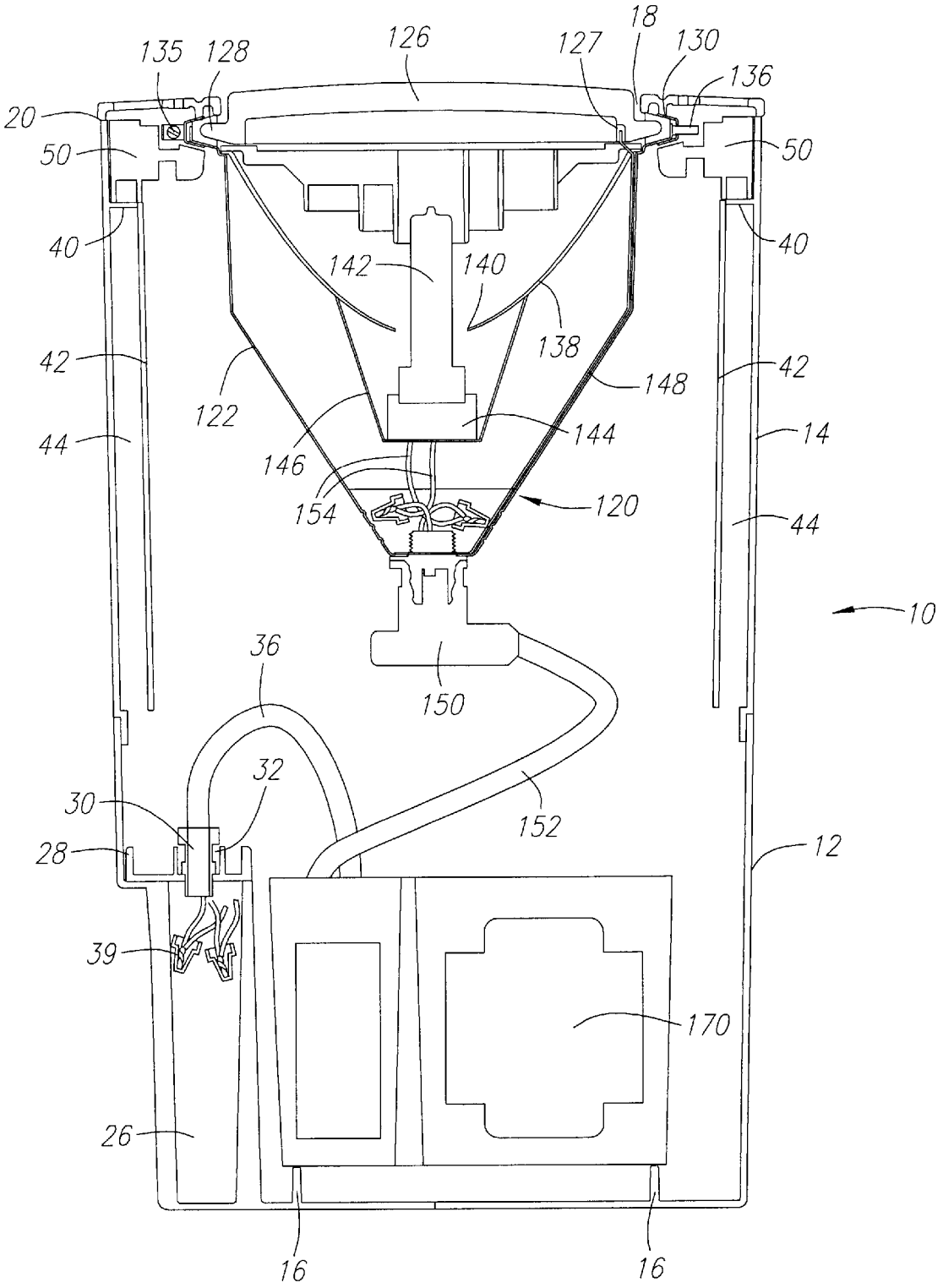
FIG. 1 is a side cross-sectional view of a lamp assembly according to one embodiment illustrating the support ring and flue plates.
Figure 2:
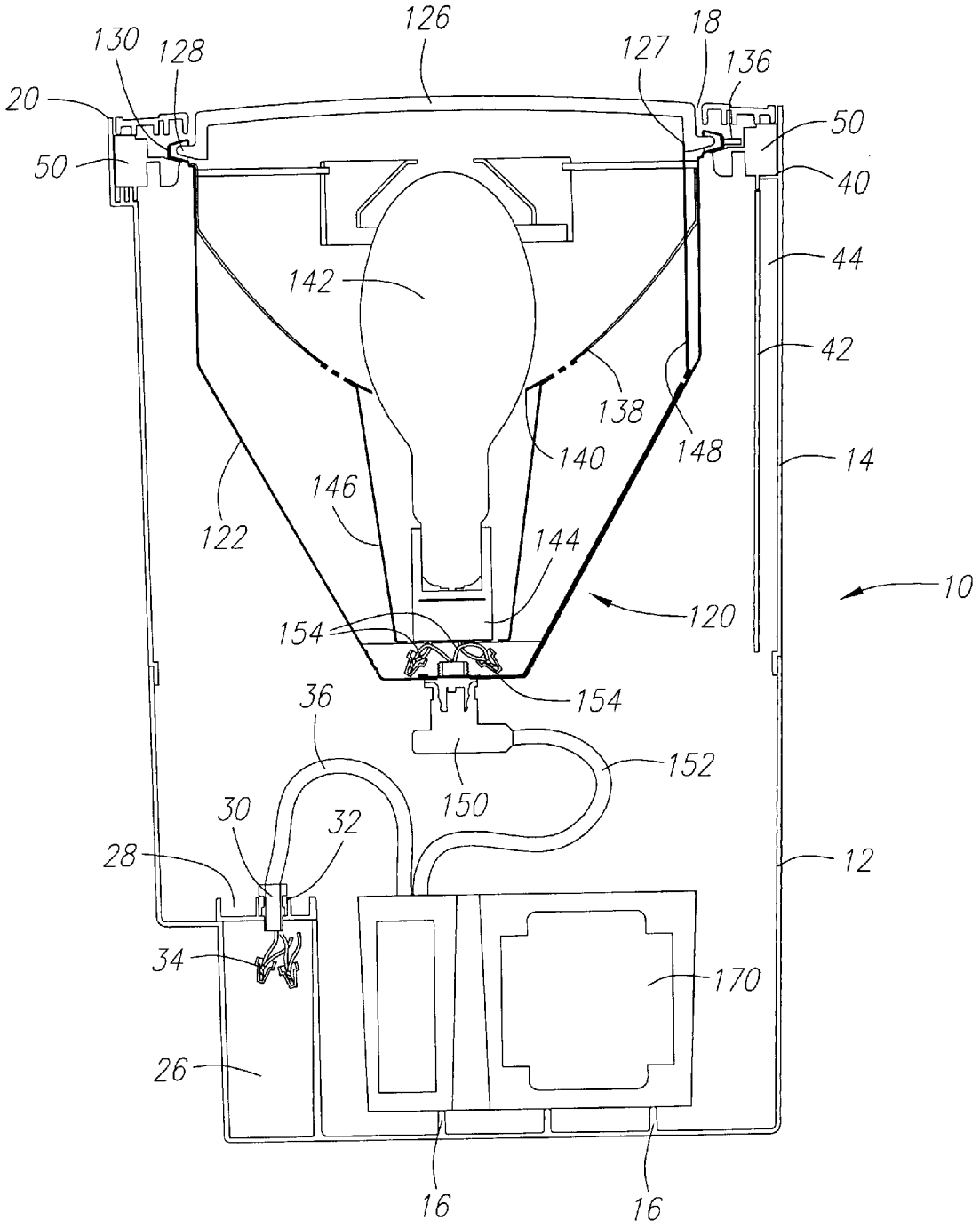
FIG. 2 is a side cross-sectional view of the lamp assembly illustrating a different lamp within the lamp module.
Figure 5:
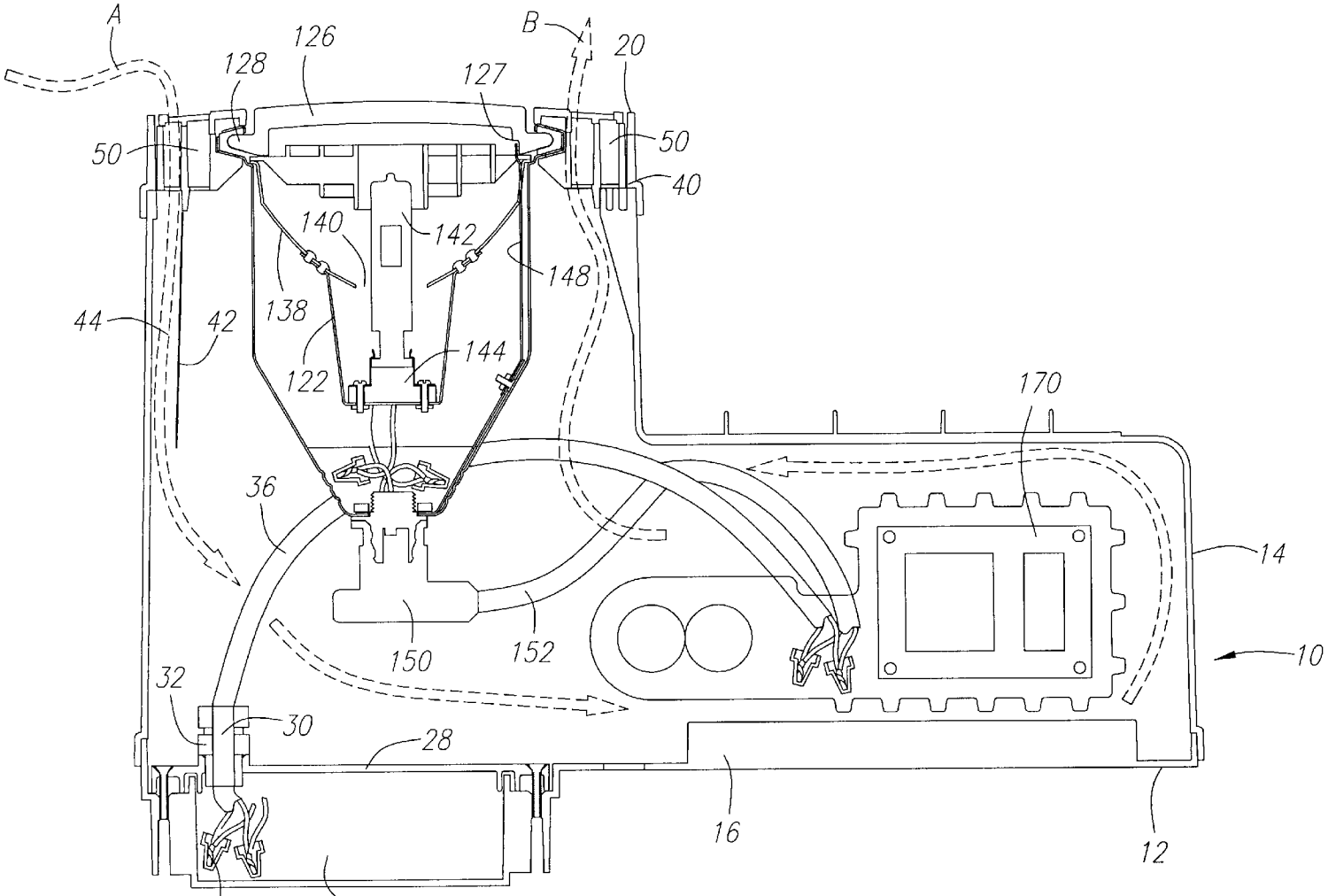
FIG. 5 is side cross-sectional view of a lamp assembly showing an alternative housing design.
Figure 6:
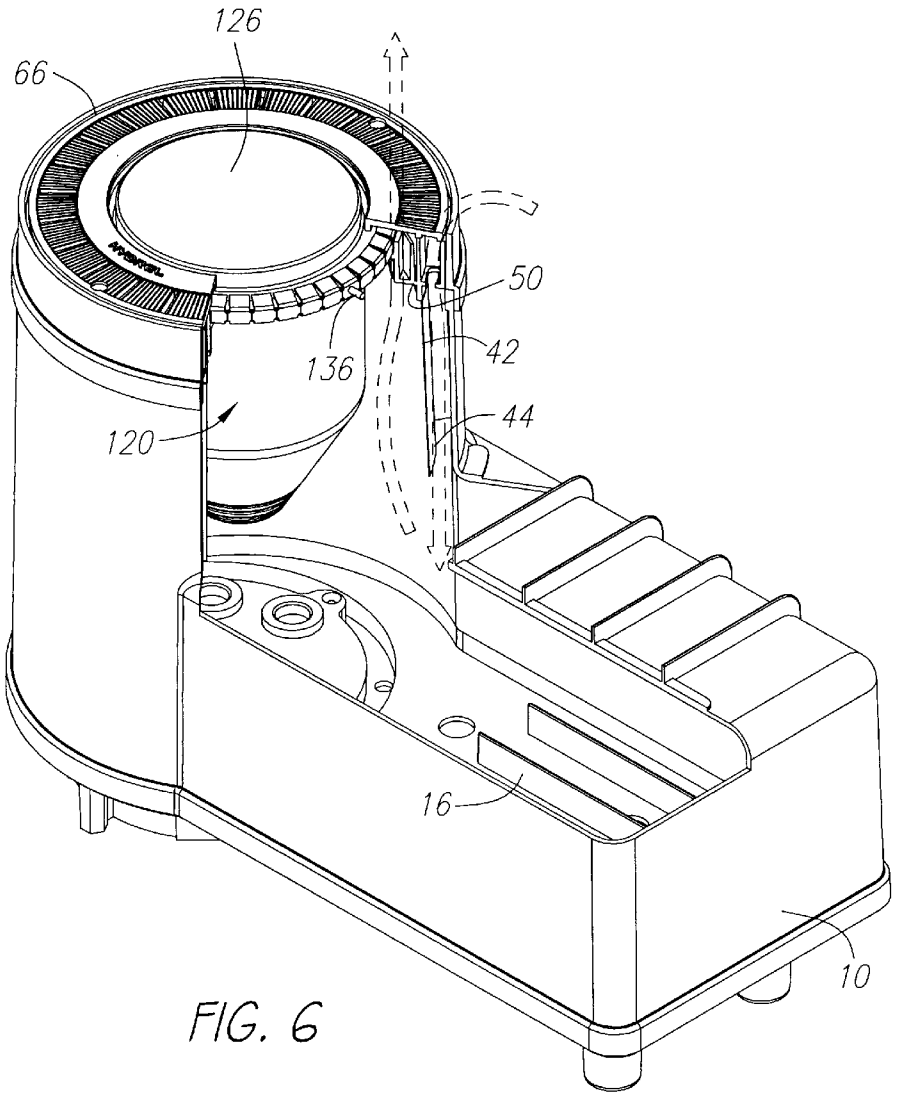
FIG. 6 is a perspective view of the lamp assembly according to FIG. 5 without the potted power module and associated electrical connections and components.
Figure 7:
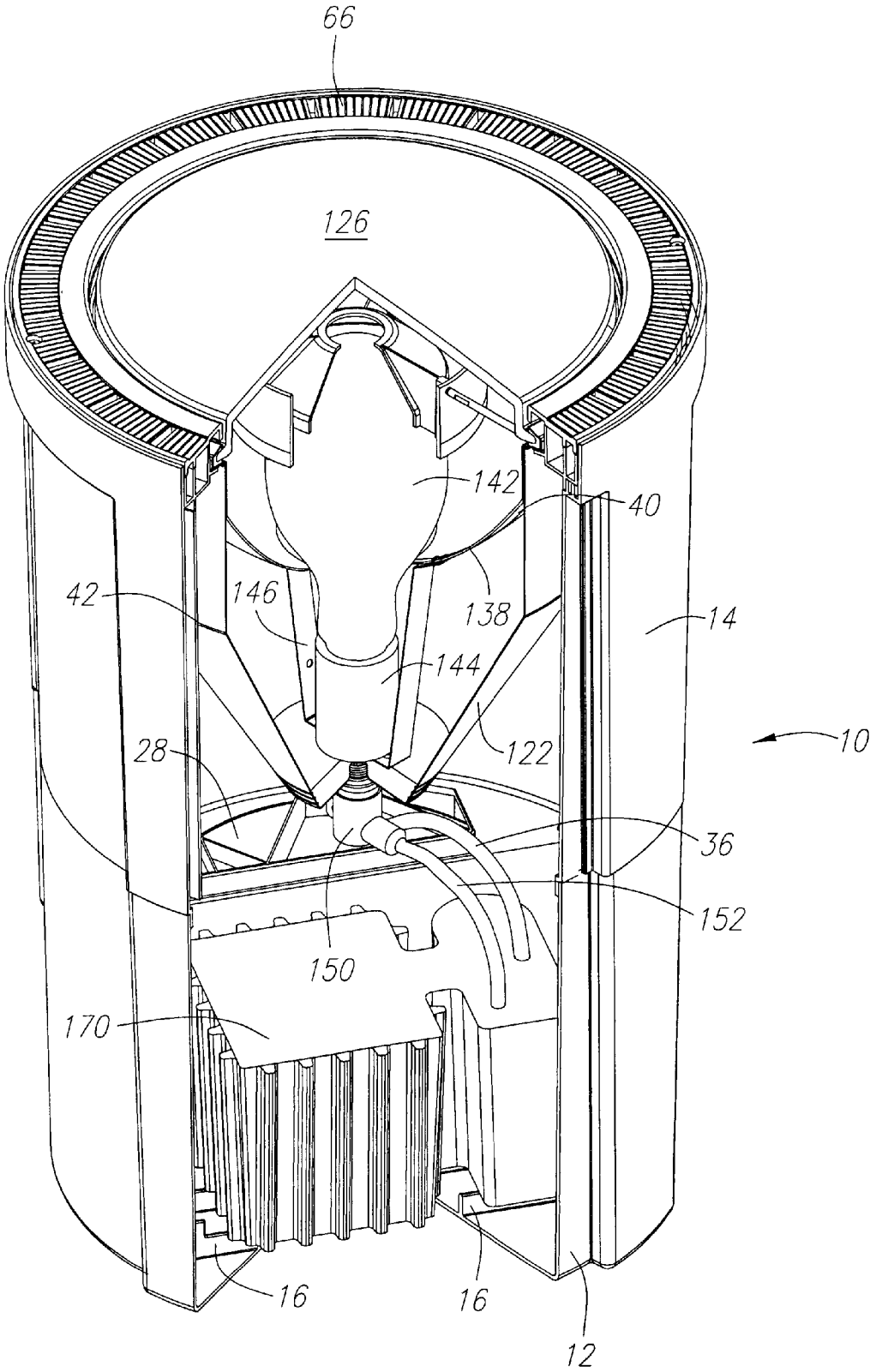
FIG. 7 is another cut-away perspective view of a lamp assembly.

Turning now in detail to the drawings, a lamp assembly positionable with a lens at grade level is illustrated. A structurally supporting housing 10 is illustrated which may take on any conventional form but is illustrated in one preferred embodiment as generally circular in cross section. However, FIG. 5 shows one alternative design for a housing 10. The housing 10 may be formed of a unitary piece, or fabricated from two pieces 12 and 14 as shown in FIGS. 1 and 2, which are joined near the center of the housing 10. Inwardly extending flanges 16 raise any components positioned within the housing 10 above the bottom thereof. One end of the housing 10 is open. This opening 18 is surrounded by an upper rim 20 that is preferably arranged at or around ground level.

A splice or junction box 26 is located within the housing 10. The splice box 26 includes a lid 28 and is enclosed in a conventional manner so as to prevent moisture intrusion. A conduit 30 is shown extending through a port 32. It also extends through the wall of the splice box 26 to provide entry thereto for wires 34. The conduit 30 may engage the wall of the housing 10 in any conventional manner. The port 32 provides communication between the splice box 26 and the interior of the housing 10. The wires 34 are spliced with the conductor 36 in the protection of the splice box 26.

A seat formed from a plurality of inner ridges 40 is located within the inner wall of the housing 10. An inwardly extending shoulder is formed in the housing 10 at several segments about the inner periphery. The plurality of inner ridges 40 project upwardly from the shoulder on each segment toward the opening in the housing 10. Preferably, the segments from which the ridges 40 extend are spaced equidistant from one another within the housing 10. Located adjacent the inner ridges 40 and abutting the ends thereof are a plurality of flues plates 42. As can best be seen in FIG. 13, the flue plates 42 are located in the interior of the housing 10 and are located in the regions adjacent to the inner ridges 40.

Figure 14:
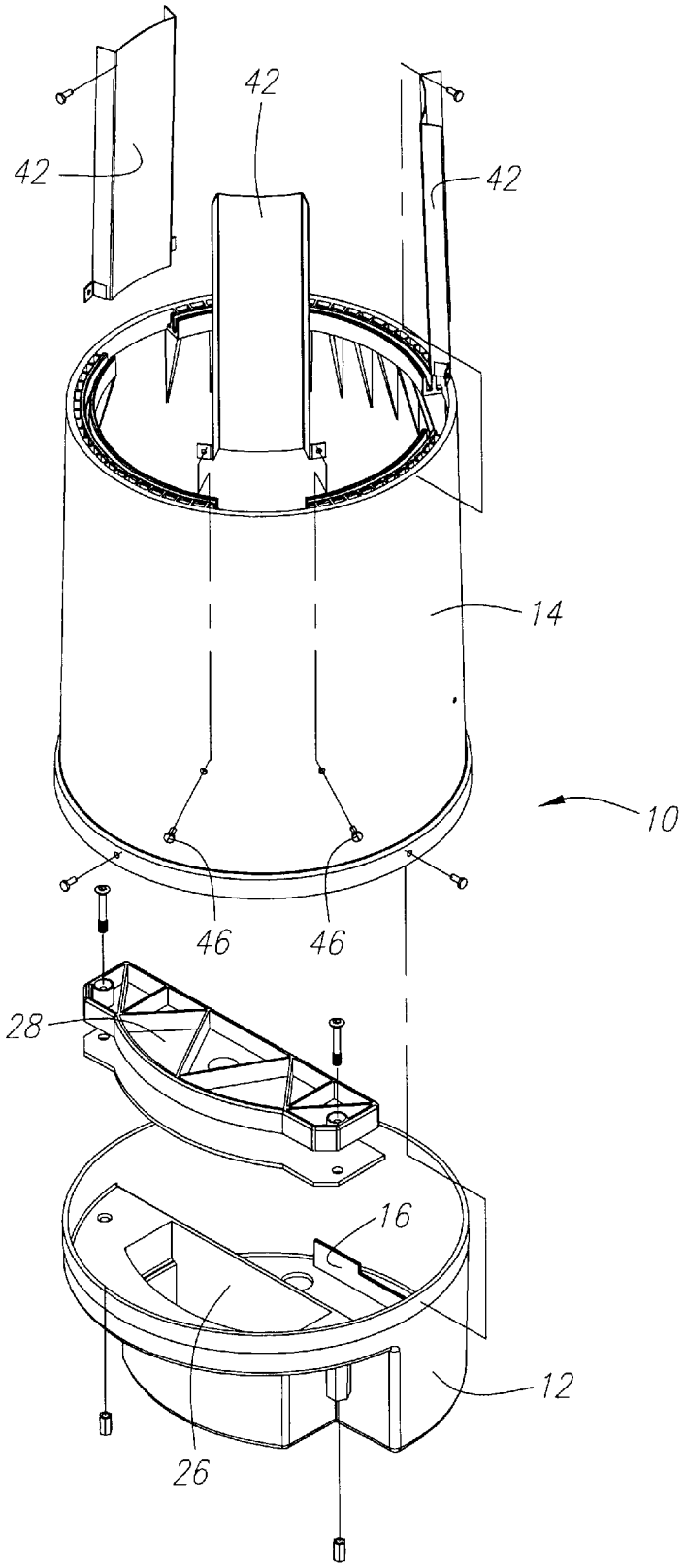
FIG. 14 is an additional exploded view showing a housing with a plurality of flue plates.

The flue plates 42 are advantageously attached to the inner ridges 40 or the inner wall of the housing 10 to form a plurality of chimneys or flues 44 along the inner side of the housing 10. As can be seen in FIG. 14, screws 46 can fixedly attach the flue plates 42 to the inner wall of the housing 10. The flues 44 aid in cooling the lamp assembly by permitting convective flow within the housing 10 during operation. The flue plates 42 may be made of stainless steel or polymer sheets.

Figure 13:
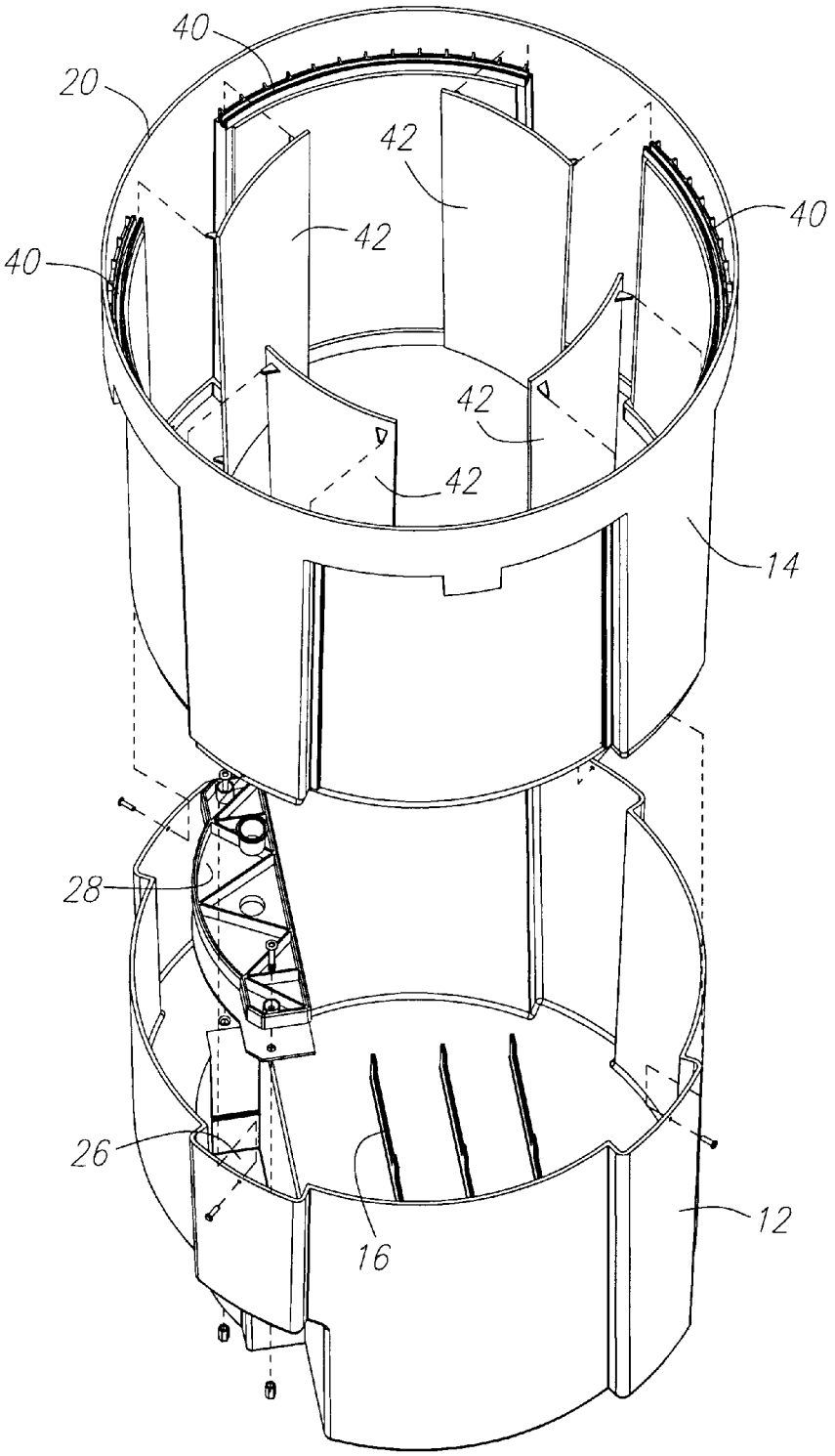
FIG. 13 is an exploded view showing the housing with a plurality of flue plates.

The number of flue plates 42 may vary depending on the number of segments having inner ridges 40 within the housing 10. For example, one preferred embodiment, as shown in FIG. 13, has four segments and four flue plates 42 forming four flues 44. This number is only exemplary, however, and the number of flues 44 within the housing 10 may be increased or decreased depending on the required level of cooling that is desired.

Referring now to the embodiments of FIGS. 1 through 8, a support ring 50 is located within the housing 10 and resting on top of the inner ridges 40. The support ring 50 is preferably a uniform ring made of high-strength polymer material.

The support ring 50 preferably has a outer wall 52, an inner wall 54 and a dividing wall 56 disposed between the outer and inner walls 52, 54. The outer wall 52 preferably has an outer diameter that is approximately equal to the inner diameter of the housing 10 above the inner ridges 40. This permits a close fit of the support ring 50 with the housing 10 while still permitting relative rotation of the support ring 50. The support ring 50 contains a plurality of vent holes 59 between the outer wall 52 and inner wall 54. The vent holes 59 located between the inner wall 54 and the dividing wall 56 serve to vent the heat that is produced in the housing 10 during operation. The vent holes 58 located between the outer wall 52 and the dividing wall 56 communicate with the flues 44 to serve as inlets for cooler air that is entering the housing 10. In this manner, as shown by the arrows A & B in FIGS. 5 and 6, an active convective flow of air is developed during operation of the lamp assembly.

In addition, located between the outer wall 52 and the dividing wall 56 are a plurality of screw holes 60. The screw holes 60 permit a retainer in the form of self-tapping screws 62 to pass therethrough to mount the support ring 50 to the housing. The self-tapping screws 62 fixedly attach the support ring 50 to the inner ridges 40 located within the housing 10. The ridges form arcuate segments that are concentric. The space between ridges forms an elongate slot able to receive the self-tapping screws 62. The slot is small enough to form an interference fit with the self-tapping screws. In this way, the support ring 50 may be positioned angularly at any point about the housing 10. The support ring 50 also contains additional taps 64 for receiving screws for the mounting of a grill 66.

Figure 3:
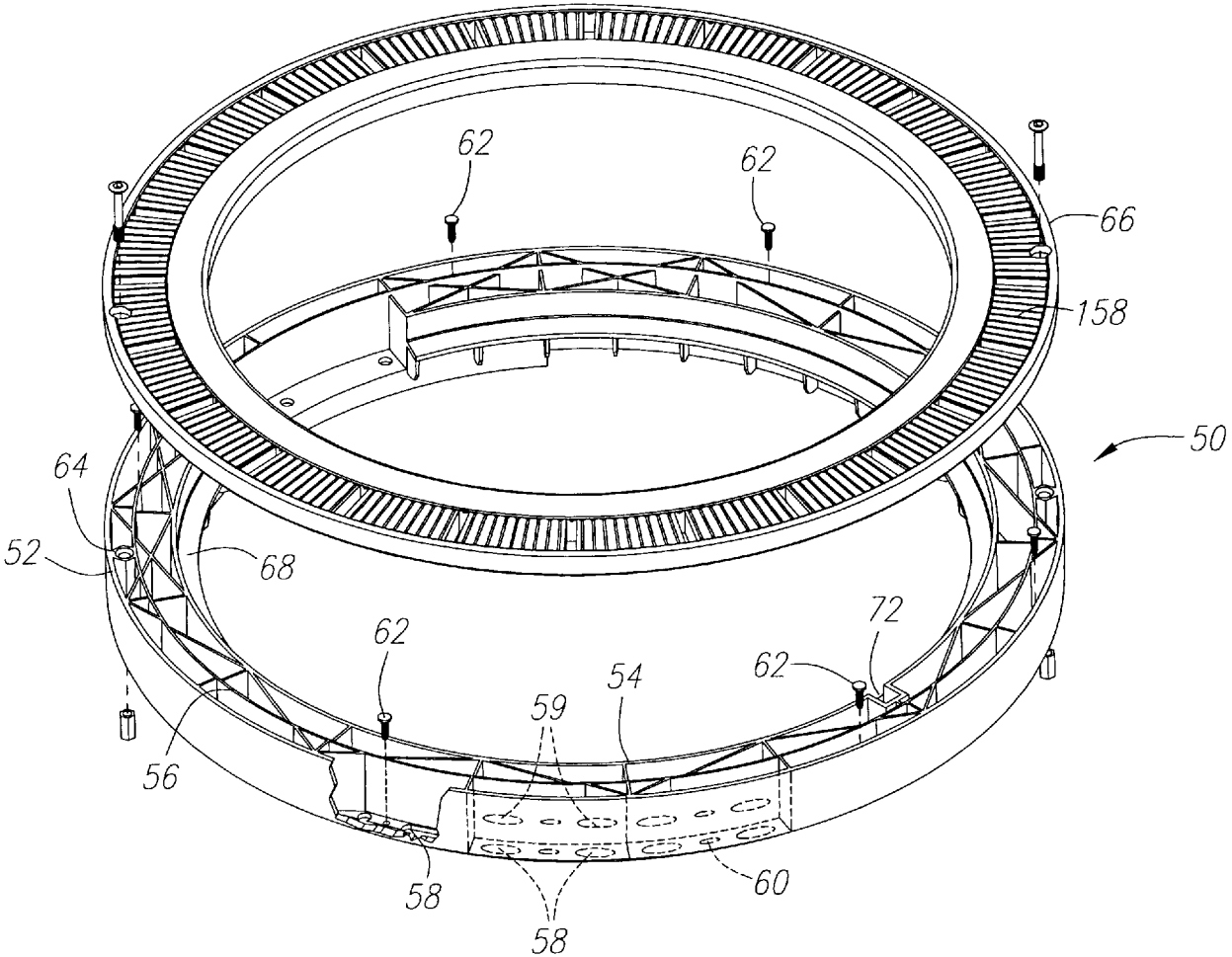
FIG. 3 is a perspective view of the support ring and grill.
Figure 4:
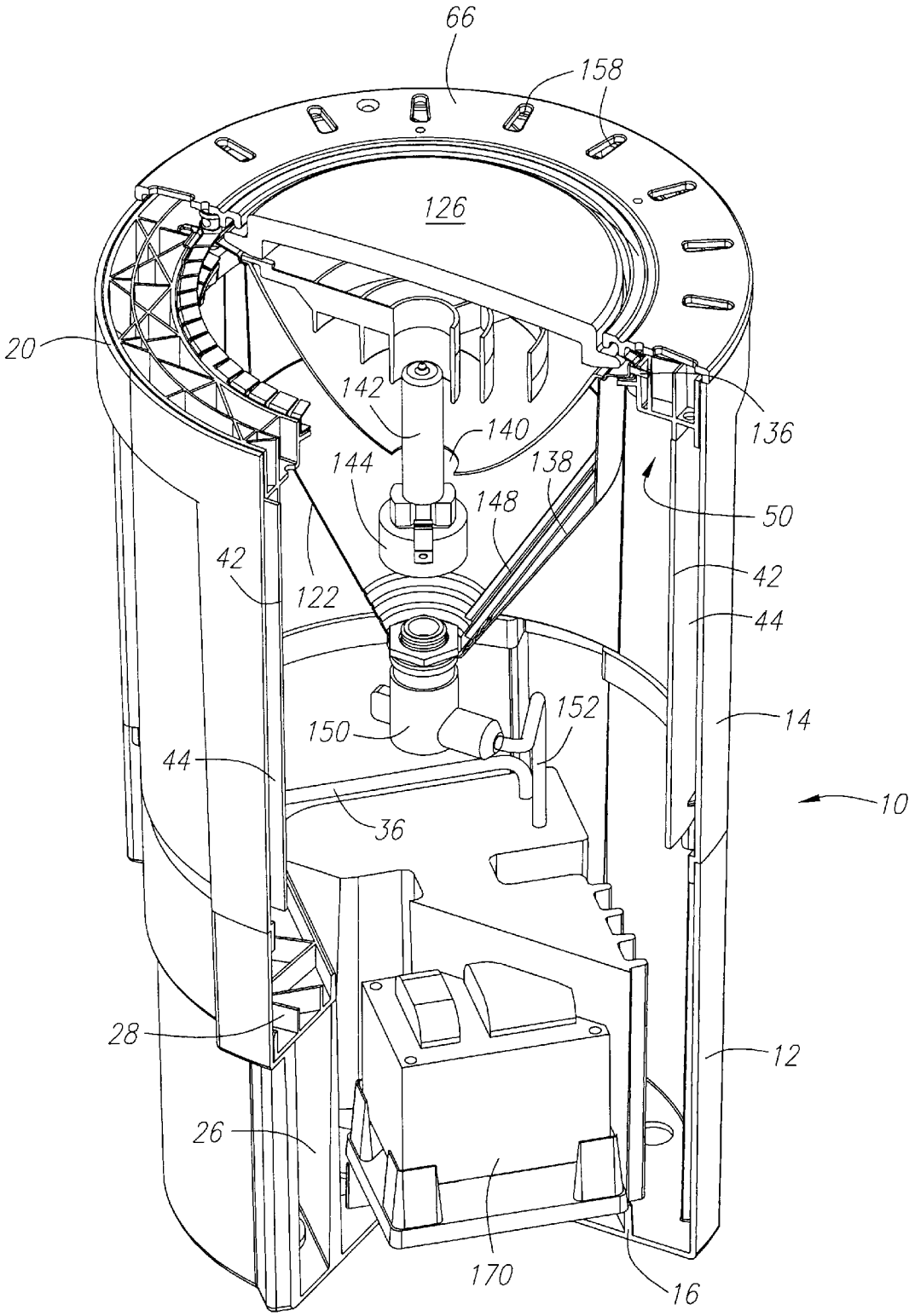
FIG. 4 is a cut-away perspective view of a lamp assembly including a support ring and attached flue plates.

The support ring 50 is thus rotatable within the housing 10 of the lamp assembly. The support ring 50 can be rotated through 360° of arc in the x-y plane as shown in FIG. 3, depending on the desired orientation and direction of the light. Once the desired location is determined, an operator merely fastens the support ring 50 to the housing 10 via the self-tapping screws 62. In this manner, the support ring is locked into a specific orientation with respect to the housing 10.

The support ring 50 further includes an inner lip 68 that projects inwardly from the inner wall 54 region. This inner lip 68 serves to support a lamp module 120 within the housing 10. The support ring 50 has a first recess 70 and a second recess 72. Preferably, the first and second recesses 70, 72 are located on the inner lip 68 and in the inner wall 54 of the support ring 50. The first and second recesses 70, 72 act to locate a lamp module 120 with a lens in the support ring 50 within the housing 10. The recess 72 acts as a keyway for a pin while the recess 70 receives mechanisms on a clamp ring. Because of the two recesses 70, 72, the lamp module may be angularly fixed in only one orientation relative to the support ring 50. The lamp module 120 can also be removed and replaced without disturbing the support ring 50. Thus, the architectural setting of the lamp assembly may be maintained when relamping.

The lamp module 120 is located near the opening 18 of the housing 10. The lamp module 120 includes a socket enclosure 122. The socket enclosure is conveniently circular in cross section terminating at an outwardly extending flange. However, the lamp module 120 with the associated socket enclosure 122 can take a variety of shapes and geometries. As seen in FIGS. 1 and 2, the socket enclosure 122 narrows at its lower end where it extends into the housing 10. Within the socket enclosure 122 a lamp cavity is defined which is closed at the upper end by a lens 126.

The lens is preferably made of tempered glass to withstand foot traffic and the like and may have a broad range of optical properties such as coloring, frosting, focusing or diverging light. The lens 126 has a mounting flange 128 about which is positioned a lens gasket 130 and a reducing ring 132. Outwardly of the mounting flange 128, the ring gasket 130 and the reducing ring 132, a clamp band assembly 134 is positioned to hold the lens in sealed engagement with the socket enclosure 122 of the lamp module 120. A clamp band screw 135 is used to tighten the clamp band assembly 134.

Figure 8:
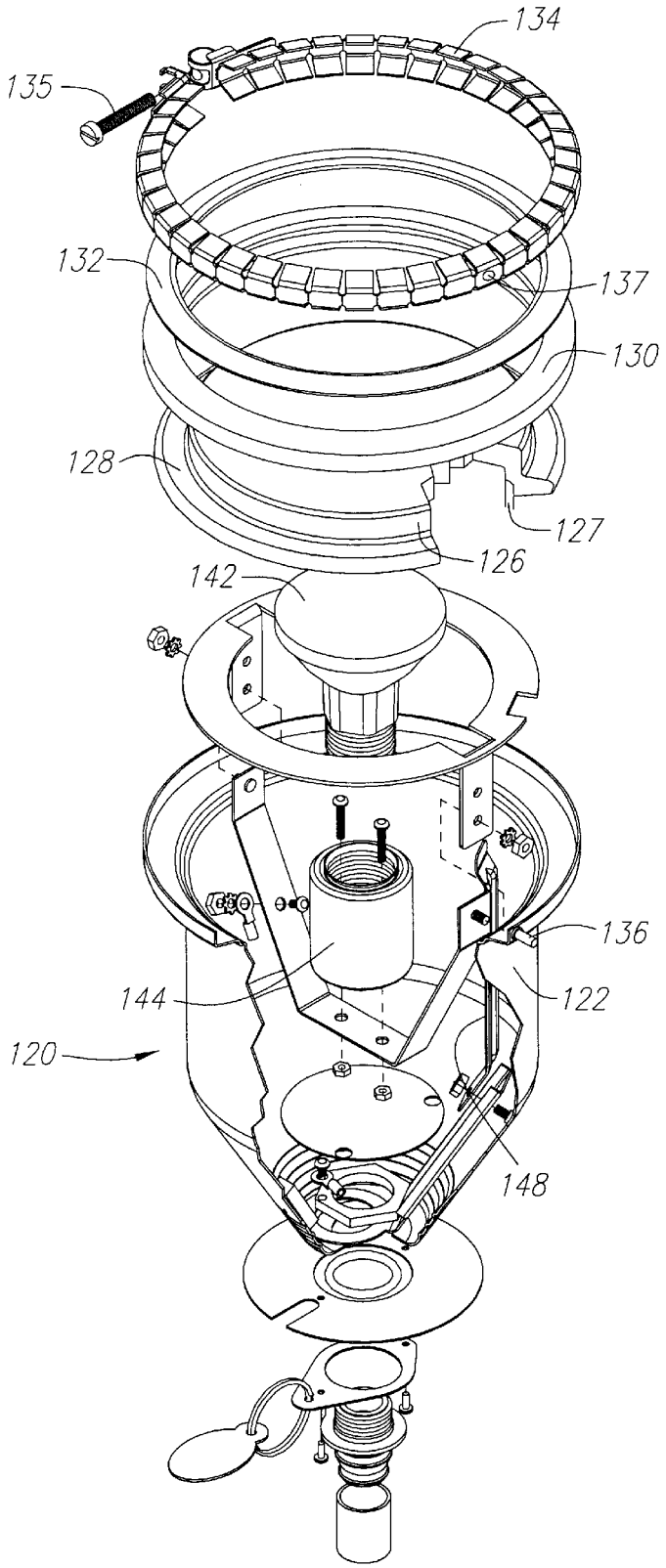
FIG. 8 is an exploded view of an assembled lamp module.

A pin 136 is also preferably located on the exterior of the lamp module 120 as shown in FIG. 8. The pin 136 passes through a hole 137 located in the clamp band assembly 134. The pin 136 serves as a key to retain the orientation of the lamp module 120 relative to either a support ring 50 or a support ring 80.

A reflector 138 is positioned within the lamp cavity. The reflector 138 has a hole 140 through which a lamp 142 extends. The reflector 138 is positioned on the socket enclosure 122 at its upper end. It should be noted that a variety of shapes and sizes of reflectors 138 and lamps 142 may be used. For example, FIGS. 1 and 2 illustrate two different types of lamps 142 capable of being used in a lamp module 120. In the same manner, different sizes and shapes of reflectors 138 may also be used. A socket 144 is located in a bracket 146 within the lamp module 120. An optics key 148 is also preferably located within the socket enclosure 122. The optics key 148 may be made of one or more pieces that form the optics key 148 when assembled. The optics key 148 can be fixedly attached to a notch therein such that the optics key 148 rises within the lamp module 120. Alternatively, the optics key 148 may be attached to the socket enclosure 122 by way of a bolt or the like. The upper portion of the optics key 148 engages a corresponding slot 127 in the lens 126. The optics key 148 thus permits the lens 126 to be keyed or locked into place relative to the lamp module 120.

At the bottom end of the socket enclosure 122, a submersible connector 150 is mounted through the wall. An electrical conductor 152 is associated with the submersible connector 150. Socket leads 154 extend from the socket 144 and are electrically coupled with leads from the electrical conductor 152. The submersible connector 150 prevents the transmission of moisture into the lamp module 120.

The lamp module 120, including the attached lens 126, is mounted to the housing 10 via the support ring 50. The clamp band assembly 134 rests on the inner lip 68 of the support ring 50. The clamp band screw 135 is received by the first recess 70 while the pin 136 engages the second recess 72 to act as a key and keyway. The engagement of the pin 136 and location of the clamp band screw 135 into the recesses 70, 72 in the support ring 50 thus keys the lamp module 120 relative to the support ring 50 in only one possible position.

The lamp module 120 is spaced inwardly of the upper rim 20 at the top of the housing 10 at the opening 18. A communication passageway thus exits between the atmosphere and the housing 10 via vent holes 58 in the support ring 50. A grill 66 having multiple slots 158 is positioned over the upper rim 20 and the support ring 50. The grill 66 advantageously has a plurality of radial slots 158 or the like extending therethrough to allow for the passage of water and air. The grill 66 may be held in place by any conventional means such as flush mounted screws or the like.

As stated previously, the vent holes 58 located between the outer wall 52 and the dividing wall 56 of the support ring 50 permit communication of the atmosphere with air located within the flues 44 of the housing 10. When the lamp 142 is operating, the hot air created from the lamp 142 and a potted power module rises and exits the lamp assembly via the vent holes 59 located between the inner wall 54 and the dividing wall 56 of the support ring 50. Simultaneously, cooler atmospheric air enters slots 158 in the outer portion of the grill 66 and travels into the flues 44 in the housing 10 via vents 58. It has been found that the presence of the flues 44 creates and maintains active convective flow within the housing 10. In this manner, a barrier is thus created within the housing 10 to physically separate the incoming and exiting air within the housing 10. Heretofore, convective flow within the housing 10 was limited due to a stratification created within the housing 10.

An electrical circuit is electrically coupled with the splice box 26 and the lamp module 120 by means of electrical conductors 36, 152. In the present circumstance, the circuit includes a capacitor, an igniter, and a transformer. The several elements are included in conventional fashion depending upon the needs of the lamp. Wicking barriers such as those disclosed in U.S. Pat. Reissue No. 34,709 may also be employed.

A potted power module 170 preferably contains the circuit components to form a complete potting of the elements. The potting material should exhibit a number of physical properties to cope with the potential harsh conditions inside the housing 10. For example, the potting material needs to exhibit multi-pour bonding, high heat transfer, resistance to thermal stress and impact strength and be fire proof and water tight. Compounds made of epoxy resin are contemplated.

In the embodiments of FIGS. 9 through 12, a support ring 80 is located within the housing 10 resting on top of the inner ridges 40. The support ring 80 is preferably a uniform ring made of high-strength polymer material. As with the support ring 50, the outer wall 82 preferably has an outer diameter that is approximately equal to the inner diameter of the housing 10 above the inner ridges 40. This close communication permits a close fit of the support ring 80 with the housing 10 while still permitting rotation of the support ring 80. The support ring 80 preferably has an outer wall 82 and an inner wall 84. A plurality of vent holes 86 are located between the outer and inner walls 82, 84. The vent holes 86 located between the inner wall 84 and the outer wall 82 serve as inlets for cooler air that is entering the housing 10. In this manner, as shown by the arrows C and D in FIG. 12, an active convective flow of air is developed during operation of the lamp assembly.

A plurality of screw holes 88 are located adjacent to the vent holes 86. The screw holes 88 permit self-tapping screws 90 to pass through to mount the support ring 80 to the housing 10. The self-tapping screws 90 fixedly attach the support ring 80 to the inner ridges 40 located within the housing 10.

Figure 9:
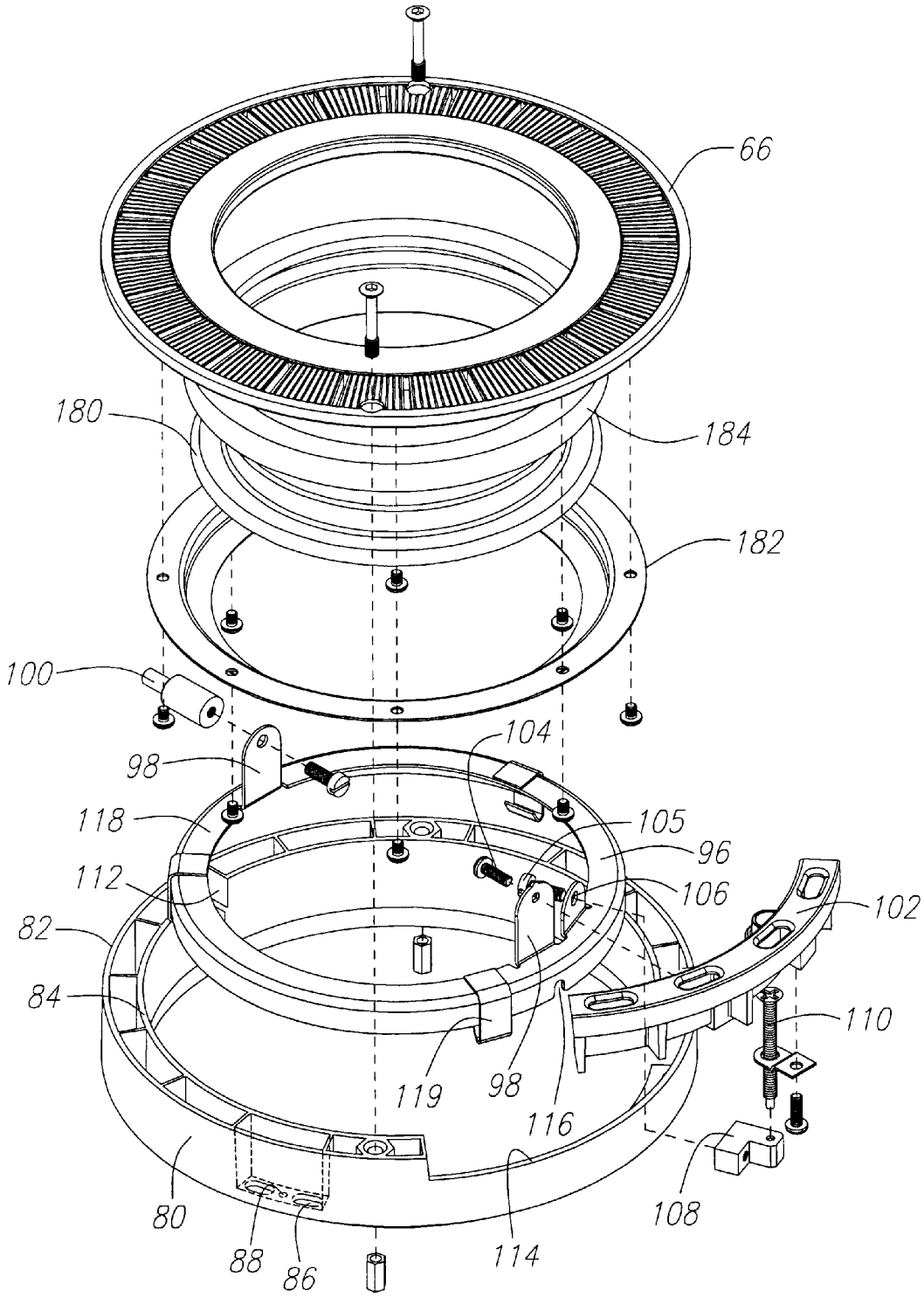
FIG. 9 is an exploded perspective view of the support ring and tilt ring according to an alternative embodiment of the present invention.
Figure 10:
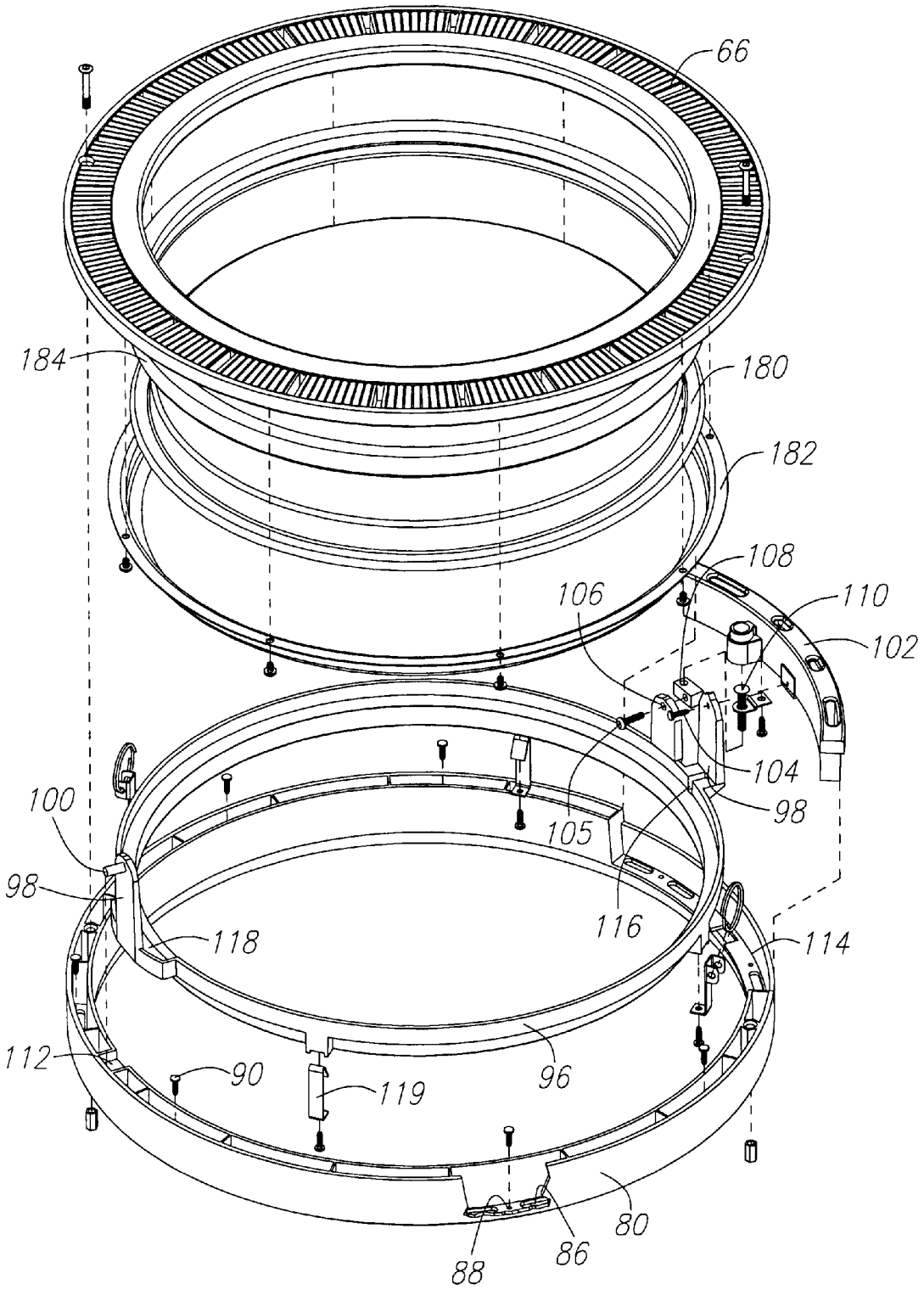
FIG. 10 is another exploded perspective view of a support ring and tilt ring.
Figure 11:
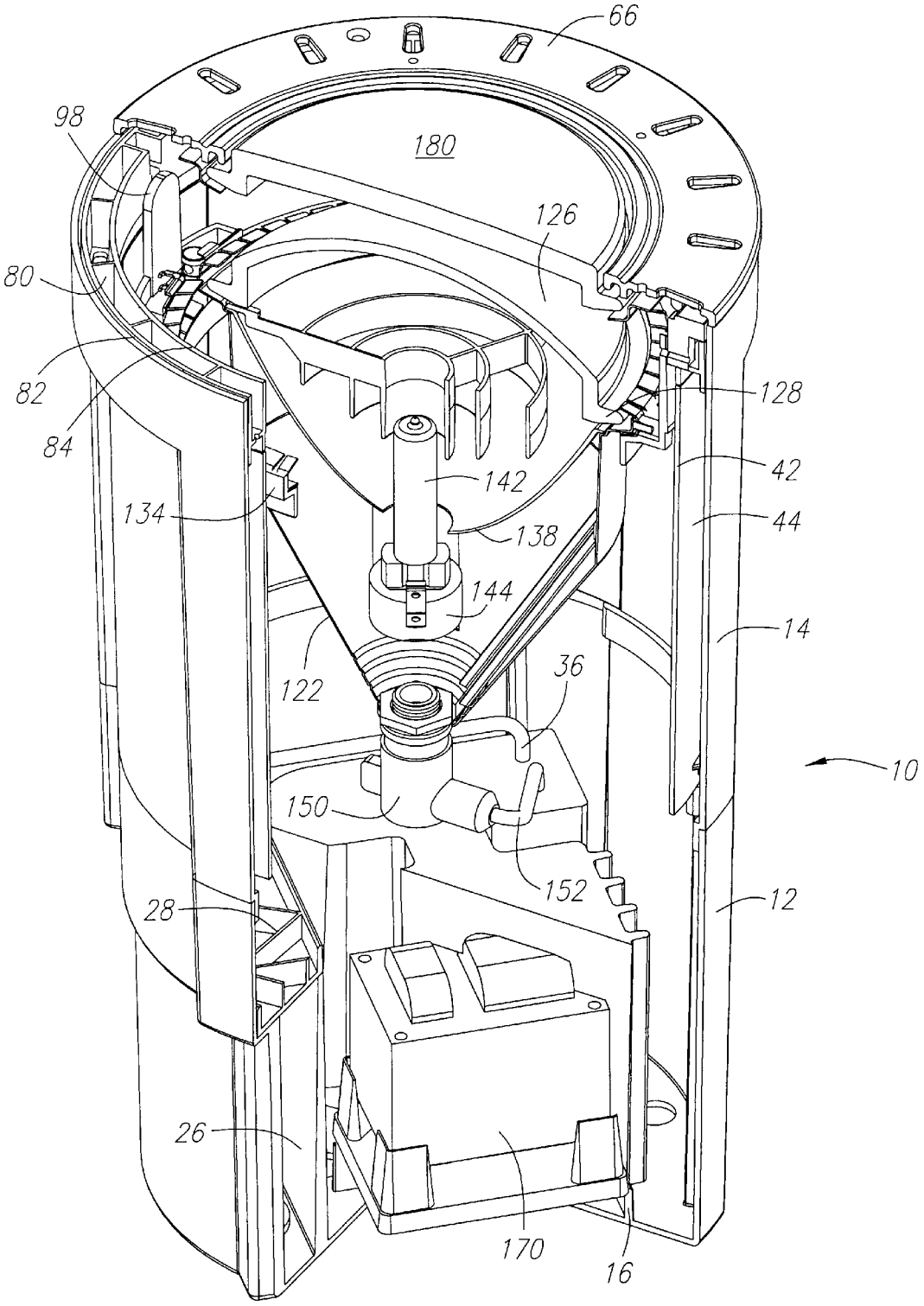
FIG. 11 is a cut-away perspective view of a lamp assembly including the support ring and tilt ring.
Figure 12:
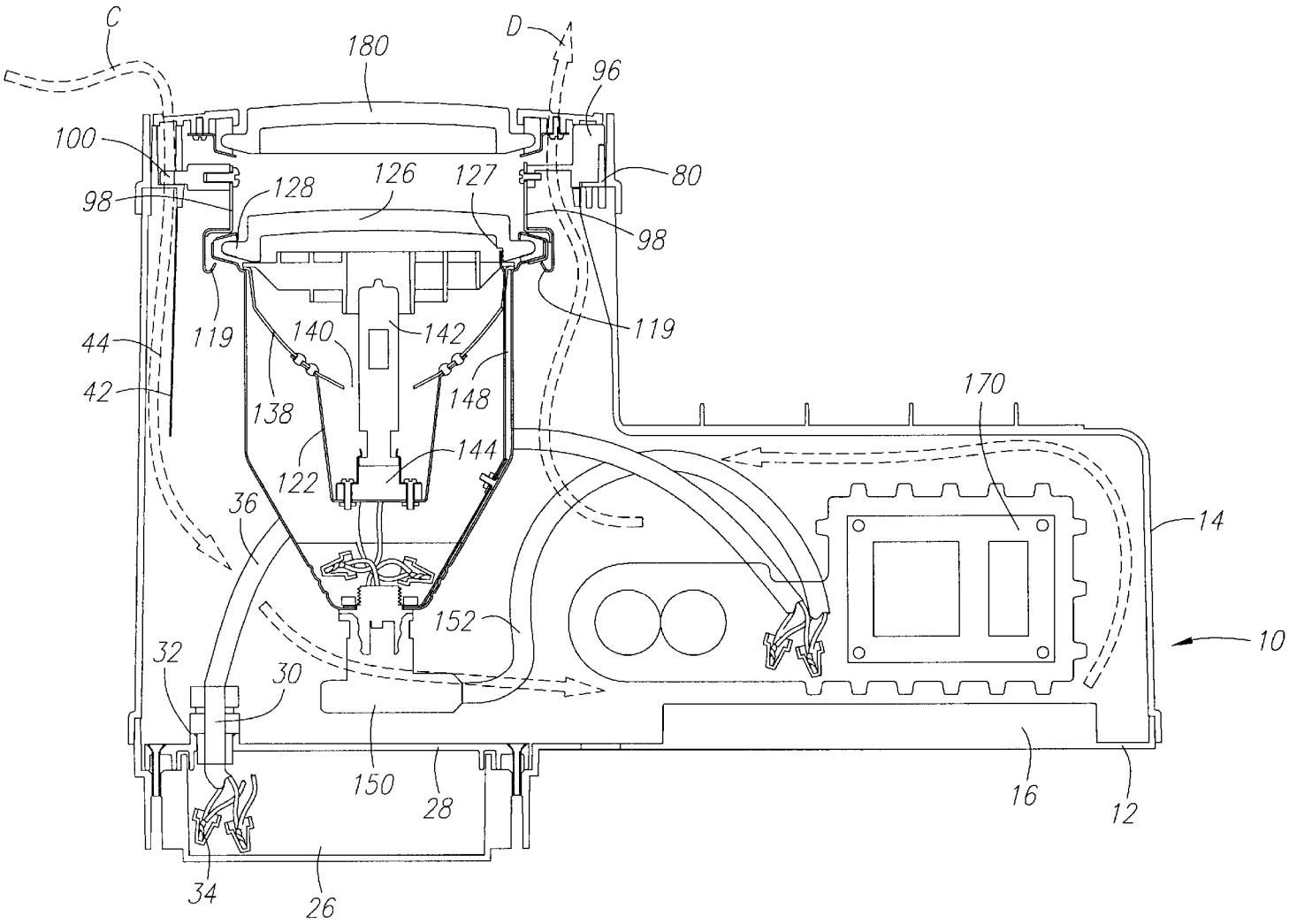
FIG. 12 is a side cross-sectional view of a lamp assembly according to an alternative embodiment of the invention.

The support ring 80 is thus rotatable within the housing 10 of the lamp assembly. The support ring 80 can be rotated through 360° of arc in the x-y plane as shown in FIG. 9, depending on the desired orientation and direction of the light. Once the desired location is determined, an operator merely fastens the support ring 80 to the housing 10 via the self-tapping screws 90. In this manner, the support ring 80 is locked into a specific orientation with respect to the housing 10.

A tilt ring 96 is located within the housing 10 and is mounted on the support ring 80. The tilt ring 96 includes a pair of opposing vertical posts 98 with one of the posts 98 having a shaft 100 extending radially away from that post 98. This shaft 100 may be integral with the vertical post 98 or may be attached via a bolt, screw, or the like as shown in FIG. 9. The opposing post 98 is connected to an adjustment key 102 via a screw 104. A separate adjustment post 106 is adjacent to the vertical post 98 connecting to the adjustment key 102. A tilt ring adjustment block 108 is connected to the adjustment post 106 via a screw 105. An adjustment screw 110 passes through the adjustment key 102 and into the adjustment block 108.

The tilt ring 96 is located within the housing 10 and is supported by the support ring 80. The support ring 80 preferably has first and second recesses 112, 114 for receiving the tilt ring 96. The first recess 112 receives the shaft 100 of one of the vertical posts 98 while the second recess 114 is larger and receives the adjustment key 102. The engagement of the shaft 100 and adjustment key 102 into corresponding recesses in the support ring 80 thus keys the tilt ring 96 relative to the support ring 80. In this manner the tilt ring 96 is held somewhat below the support ring 80 within the housing 10. A space is present between the support ring 80 and the tilt ring 96. This provides clearance for tilting and a passageway for heat to migrate to the periphery of the lamp module 120 for convection from the housing.

A pin recess 116 and a clamp band screw recess 118 are located on the underside or inner portion of the tilt ring 96 as seen in FIG. 9. Both the pin recess 116 and the clamp band recess 118 receive the pin 136 and clamp band screw 135, respectively, from a lamp module 120 with a lens 126. Alternatively, both the pin recess 116 and clamp band recess 118 can be located on the upper portion of the tilt ring 96. This is particularly advantageous in larger light assemblies, such as that shown in FIG. 10.

The several embodiments contemplate using the same or scaled up versions of the lamp modules 120. The modular nature of the completed lamp module 120 allows the same to thus be used either with a support ring 50 or a support ring 80 with associated tilt ring 96. The engagement of the pin 136 and clamp band screw 135 into corresponding recesses 116, 118 on the tilt ring 96 thus keys the lamp module 120 relative to the support ring 80 and the tilt ring 96.

A plurality of clips 119 advantageously hold the lamp module 120 to the tilt ring 96. The clips 119 may hold the lamp module 120 to the tilt ring 96 by the shear resilient nature of the clips 119 or through screws that attach to the tilt ring 96. In this second embodiment, the lamp module 120 is located lower within the housing 10 than the lamp module 120 and of the first embodiment. This can be seen in FIGS. 11 and 12.

A surface lens 180 is located above the lamp module 120. This surface lens 180 is sandwiched between a lens ring 182 and a grill 66. Preferably, a lens gasket 184 is disposed about the surface lens 180 between the lens ring 182 and the grill 66 to aid in soft mounting of the lens 180. This surface lens 180 is then mounted near the opening 18 of the housing 10. A gap is thus created between the surface lens 180 and the lens 126 of the lamp module 120. This gap permits the surface lens 180 to be much cooler during operation of the lamp assembly. Temperatures can be as much as about 30° C. cooler at the surface of the lamp assembly than other designs where the primary lens is the surface lens 180.

Unlike the support ring 50, the tilt ring 96 provides the ability to tilt or pivot a lamp module 120, thus giving the lamp assembly an additional degree of motion over the support ring 50. The tilting is accomplished by turning the adjustment screw 110 on the adjustment key 102. A clockwise rotation of the adjustment screw 110 causes tiling in a first direction, while a counter-clockwise rotation of the adjustment screw 110 causes tilting in an opposite direction. This aiming operation is independent of the placement and removal of the removable lamp module 120. Consequently, the architectural setting of the lamp can be maintained during relamping.

During operation of the lamp assembly with the tilt ring 96, the flues 44 operate in a similar fashion as when there is no tilt ring. The support ring 80 preferably has an inner wall 84 and an outer wall 82. Vent holes 86 are located between these two walls on the support ring 80. The inner wall 84 acts as the dividing wall separating the cool and hot air that exits and enters the housing 10. Thus, during operation of the lamp assembly, hotter air that is created from the operation of the lamp assembly rises through the housing 10 and out to the atmosphere through the grill 66 without passing through any of the vent holes 86. The vent holes 86 located on the support ring 80 communicate with the flue 44 passages to draw cool air into the housing 10. Convective flow within the housing 10 is thus created and maintained.

It should be noted that whether or not there is a tilt ring, the embodiments utilize similar aspects. For example, the housing 10, splice box 26, inner ridges 40, flue plates 42, lamp module 120, and potted power module 170 are contemplated. Common use of element numbers illustrate similar components among the several embodiments.

Thus, a lighting system has been disclosed that provides for improved cooling through the use of a plurality of flues within the housing. In addition, the lamp assembly and lens is able to be keyed or locked relative to the housing such that reaiming of the light is not necessary when the lamp assembly is relamped or maintenance is performed. While embodiments and applications of this invention have been shown and described, it would be apparent to those skilled in the art that many more modifications and substitutions of known equivalents are possible without departing from the scope of the invention. The invention, therefore is not to be restricted except in the spirit of the appended claims.

What is claimed is:

1. A lamp assembly comprising:

a housing including a seat within the housing;

a support ring positioned on the seat within the housing, the support ring being rotatable on the seat;

a retainer fixable between the housing and the support ring for retaining the support ring fixed from rotation in the housing;

a lamp module removably mounted within the housing supported by the support ring, one of the support ring and the lamp module including a key and the other of the support ring and the lamp module including a keyway receiving the key when the lamp module is positioned on the support ring.

2. The lamp assembly of claim 1, the retainer being self-tapping screw.

3. The lamp assembly of claim 2, the seat being a plurality of ridges forming a slot therebetween to receive the self-tapping screws.

4. The lamp assembly of claim 1, the key being a pin on the periphery of the lamp module.

5. The lamp assembly of claim 1, the lamp module and the support ring fitting together only with the key and keyway engaged.

6. The lamp assembly of claim 1, the lamp module further including a socket enclosure and a lens removably positioned on the socket enclosure, one of the socket enclosure and the lens having an optics key and the other of the socket enclosure and the lens having an optics keyway receiving the optics key when the lens is positioned on the socket enclosure.

7. The lamp assembly of claim 6, the socket enclosure and the lens fitting together only with the optics key and optics keyway engaged.

8. The lamp assembly of claim 6, the optics key being fixed to the socket enclosure and the keyway being a groove on the inner surface of the lens.

9. The lamp assembly of claim 1, the support ring being capable of 360° rotation within the housing prior to fixing of the retainer between the support ring and the seat.

10. The lamp assembly of claim 1, the support ring having a plurality of vent holes therethrough permitting atmospheric communication with the interior of the housing around the lamp module.

11. The lamp assembly of claim 10 further comprising a plurality of flue plates disposed within the housing to form a plurality of flues extending into the housing from the support ring, the flues communicating with a portion but less than all of the plurality of vent holes.

12. The lamp assembly of claim 1, the support ring further including a tilt ring pivotally engaged with the support ring and having an adjustment piece, the adjustment piece extending between the support ring and the tilt ring to lock the angular position of the tilt ring relative to the support ring, the lamp module being removably mounted on the tilt ring, the tilt ring of the support ring including one of the key and the keyway.

13. The lamp assembly of claim 12, the lamp module and the tilt ring fitting together only with the key and keyway engaged.

14. The lamp assembly of claim 12, the lamp module further including a socket enclosure and a lens removably positioned on the socket enclosure, one of the socket enclosure and the lens having an optics key and the other of the socket enclosure and the lens having an optics keyway receiving the optics key when the lens is positioned on the socket enclosure.

15. The lamp assembly of claim 14, the lamp module and the tilt ring fitting together only with the key and keyway engaged and the socket enclosure and the lens fitting together only with the optics key and optics keyway engaged.

16. The lamp assembly of claim 12, the tilt ring being connected to the lamp module through a plurality of clips.

17. The lamp assembly of claim 12, the support ring having a plurality of vent holes therethrough and the tilt ring and the support ring including space therebetween, the vent holes and the space between the support ring and the tilt ring providing circulation of external air in the housing.

18. The lamp assembly of claim 17 further comprising a plurality of flue plates disposed within the housing to form a plurality of flues extending into the housing from the support ring, the flues communicating with the vent holes.

19. A lamp assembly comprising:

a housing with an opening in one end;

a lamp module positionable within the housing with an annular space therebetween;

a lens extending across the opening of the housing with an annular space therebetween;

an annular ring with vent holes therethrough extending between the lamp module and the housing;

a plurality of flue plates disposed within the housing to form a plurality of flues extending into the housing from below the annular ring, the flues communicating with the vent holes for creating and maintaining a convective cooling flow within the housing during operation.

20. The lamp assembly of claim 19 further comprising a grill extending between the lamp module and the housing, the housing including a seat within the housing, the annular ring being a support ring positioned on the seat, the lamp module being supportable on the support ring, the support ring having a divider between the first and second portions of the plurality of vent holes extending up to the grill.

21. A lamp assembly comprising a housing including a seat within the housing and an opening in one end;

a support ring with a plurality of vent holes positioned on the seat within the housing, the support ring being rotatable on the seat;

a retainer fixable between the housing and the support ring for retaining the support ring fixed from rotation in the housing;

a lamp module positionable within the housing with an annular space therebetween supported by the support ring, one of the support ring and the lamp module including a key and the other of the support ring and the lamp module including a keyway receiving the key when the lamp module is positioned on the support ring, the lamp module further including a socket enclosure and a lens removably positioned on the socket enclosure, one of the socket enclosure and the lens having an optics key and the other of the socket enclosure and the lens having an optics keyway receiving the optics key when the lens is positioned on the socket enclosure;

a plurality of flue plates disposed within the housing to form a plurality of flues extending into the housing from below the support ring, the flues communicating with some but not all of the vent holes for creating and maintaining a convective cooling flow within the housing during operation.

22. A lamp assembly comprising a housing including a seat within the housing and an opening in one end;

a lens extending across the opening of the housing with an annular space therebetween;

a support ring with a plurality of vent holes positioned on the seat within the housing, the support ring being rotatable on the seat, the support ring including a tilt ring pivotally engaged with the support ring and having an adjustment piece, the adjustment piece extending between the support ring and the tilt ring to lock the angular position of the tilt ring relative to the support ring, the lamp module being positionable on the tilt ring;

a retainer fixable between the housing and the support ring for retaining the support ring fixed from rotation in the housing;

a lamp module positionable within the housing with an annular space therebetween supported by the support ring, one of the support ring and the lamp module including a key and the other of the support ring and the lamp module including a keyway receiving the key when the lamp module is positioned on the support ring, the lamp module further including a socket enclosure and a lens removably positioned on the socket enclosure, one of the socket enclosure and the lens having an optics key and the other of the socket enclosure and the lens having an optics keyway receiving the optics key when the lens is positioned on the socket enclosure;

a plurality of flue plates disposed within the housing to form a plurality of flues extending into the housing from below the support ring, the flues communicating with the vent holes, the space between the support ring and the tilt ring and the vent holes creating and maintaining a convective cooling flow within the housing during operation.

* * * * *